US005960230A

United States Patent [19]

Peter

[11] Patent Number: 5,960,230

[45] Date of Patent: Sep. 28, 1999

[54] ADAPTIVE PAPER LEVEL SENSING IN AN IMAGING DEVICE

[75] Inventor: Gary M. Peter, Boise, Id.

[73] Assignee: Hewlett-Packard Company, Palo Alto, Calif.

[21] Appl. No.: 09/239,644

[22] Filed: Jan. 28, 1999

[51] Int. Cl.[6] ..... G03G 15/00; B65H 3/44

[52] U.S. Cl. ..... 399/23; 271/9.03

[58] Field of Search ..... 271/9.03, 9.12, 271/111, 258, 265; 399/16, 23, 361

[56] References Cited

U.S. PATENT DOCUMENTS 5,629,672 5/1997 Brown et al. ..... 340/540

*Primary Examiner*—Arthur T. Grimley
*Assistant Examiner*—Hoang Ngo
*Attorney, Agent, or Firm*—Lane R. Simmons

[57] ABSTRACT

An imaging device includes a mechanism and method for approximating media count in a media tray by utilizing course granularity levels of media detected in the tray in combination with an actual count of media processed by the imaging device. A preferred method of determining media count in a media holding tray includes detecting a first course granularity level of media in the holding tray, counting a number of individual media removed from the holding tray, detecting a second course granularity level of media in the holding tray and, calculating the number of media remaining in the holding tray based upon at least the second level of media detected and the counted number of individual media removed from the tray.

13 Claims, 3 Drawing Sheets

ADAPTIVE PAPER LEVEL SENSING IN AN IMAGING DEVICE

FIELD OF THE INVENTION

This invention relates in general to image forming devices and, more particularly, to determining media sheet count in a holding tray of an imaging device.

BACKGROUND OF THE INVENTION

In printers, copiers, facsimile machines and other imaging devices, it is desirable to be able to track and report how much paper or other media remains in the media tray for use with the device. To this regard, it has been known to include sensing apparatus in the media tray for sensing how full or empty the tray is. Such sensing apparatus may include, for example, a ratcheting mechanism coupled with a media lifting plate in the media tray. As paper is removed from the top of the stack on the media lifting plate for processing in the imaging device, the ratcheting mechanism ratchets the lifting plate up at given intervals, thus keeping the top of the stack of paper available for the media pick mechanism of the imaging device. The incremental ratchet intervals of the ratcheting mechanism are monitored by the imaging device to determine an approximation of how full or empty the tray is with media.

Alternative to a ratcheting mechanism, more sophisticated electronic or light sensors may be employed in connection with the media lifting plate or media itself to determine an approximation of how full or empty the tray is with media. Additionally, in a stationary stack media tray where the pick mechanism is positioned to contact the sheet media, the movement of the pick mechanism may be monitored.

One drawback with conventional media level monitoring mechanisms is that they typically only provide a coarse level of granularity that approximates how full or empty the tray is with media. In other words, only a percentage of how full or empty the tray is can be detected. These mechanisms do not detect the quantity of media actually in the tray. Namely, they do not count or detect a count of how many sheets are in the tray. For example, the ratcheting mechanism or sensors typically only detect coarse levels of granularity in the media tray, such as at levels of 0%, 25%, 50%, 75% and 100%, relative to the tray being full or empty. Although more complicated mechanisms may be employed to improve the granularity for enhanced estimation of how full or empty the tray is, the same are more costly and therefore often undesirable or not feasible in low-end imaging devices that are sensitive to cost issues.

Although a coarse granularity measurement may be sufficient for some users when the media tray is relatively full, a finer granularity or more accurate measurement is often desirable as the tray becomes more empty. For example, when the tray is less than 25% full, there is typically more of a valid concern as to whether sufficient media remains in the tray to finish the next print job (as compared to a 75% or 100% full tray). This is especially true for networked or remotely located imaging devices. Thus, as sheet media is consumed in an imaging device, it is often desirable to know how many sheets actually remain in the tray to avoid running out in the middle of a job.

However, conventional low-cost measurement techniques simply do not detect how many sheets actually remain in the tray because the number may vary depending upon the type, and especially thickness, of the media being used. Typically, media thickness is a variable that is difficult to measure.

Accordingly, an object of the present invention is to provide a method and apparatus for determining sheet count in a media holding tray of an imaging device, regardless of the media thickness (so long as all of the media in the tray is of the same thickness).

SUMMARY OF THE INVENTION

According to principles of the present invention in a preferred embodiment, an imaging device includes a mechanism for approximating media count in a media holding tray by utilizing course granularity levels of media detected in the tray in combination with an actual count of media processed by the imaging device. A preferred method of determining media count in a media holding tray includes detecting a first course granularity level of media in the holding tray, counting a number of individual media removed from the holding tray, detecting a second course granularity level of media in the holding tray and, calculating the number of media remaining in the holding tray based upon at least the second level of media detected and the counted number of individual media removed from the tray.

Other objects, advantages, and capabilities of the present invention will become more apparent as the description proceeds.

DETAILED DESCRIPTION OF THE INVENTION

Figure 1:
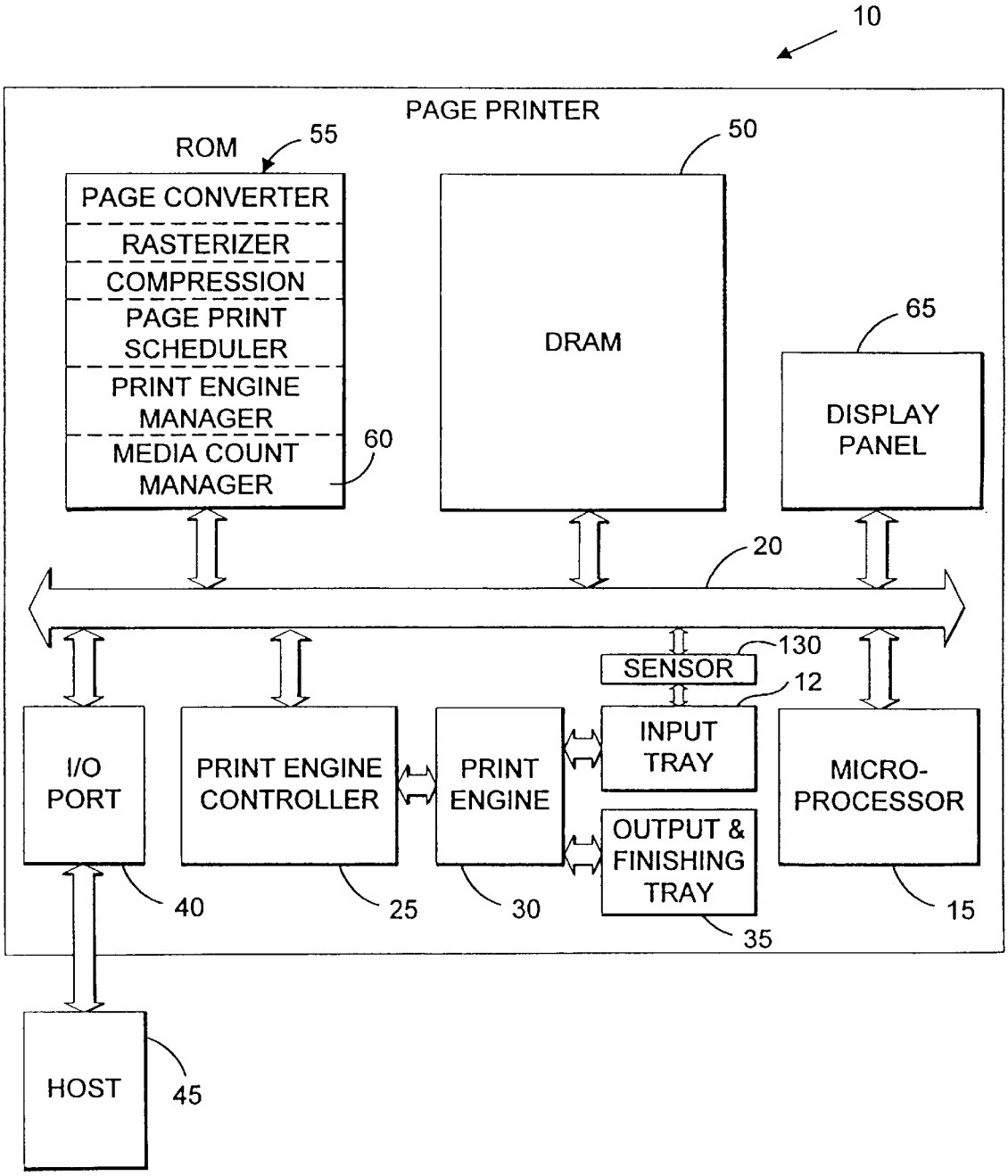
FIG. 1 is a block diagram of a printer embodying the present invention apparatus and method for determining sheet count in a media holding tray of the printer.

FIG. 1 is a block diagram of a page printer 10 embodying the present invention method and apparatus for determining sheet count in a media holding tray (input tray) 12 of the printer. Page printer 10 is controlled by a microprocessor 15 which communicates with other elements of the system via bus 20. A print engine controller 25 and associated print engine 30 connect to bus 20 and provide the print output capability for the page printer. Sheet media is pulled from input tray 12 into print engine 30 and directed to output and finishing tray 35. Sensor 130 is coupled to tray 12 and detects coarse granularity levels of media in tray 12. Sensor 130 is described more fully subsequently herein.

For purposes of this disclosure, print engine 30 is a laser printer that employs an electrophotographic drum imaging system, as well known in the art. However, as will be obvious to those of ordinary skill in the art, the present invention is similarly applicable to other types of printers and/or imaging devices that employ an input tray including, for example, inkjet printers, facsimile machines, copiers, or the like.

An input/output (I/O) port 40 provides communications between the page printer 10 and a host computer 45 and receives page descriptions (or raster data) from the host for processing within the page printer. A dynamic random access memory (DRAM) 50 provides a main memory for the page printer for storing and processing a print job data stream received from host 45. A read only memory (ROM) 55 holds firmware which controls the operation of microprocessor 15 and page printer 10. The code procedures stored in ROM 55 may include a page converter, rasterizer, compression code, page print scheduler and print engine manager. The page converter firmware converts a page description received from the host to a display command list, with each display command defining an object to be printed on the page. The rasterizer firmware converts each display command to an appropriate bit map (rasterized strip) and distributes the bit map into memory 50. The compression firmware compresses the rasterized strips in the event insufficient memory exists in memory 50 for holding the rasterized strips. The rasterized strips are passed to print engine 30 by print engine controller 25, thereby enabling the generation of an image (i.e., text/graphics etc). The page print scheduler controls the sequencing and transferring of page strips to print engine controller 25. The print engine manager controls the operation of print engine controller 25 and, in turn, print engine 30.

ROM 55 further includes a media count manager procedure 60 for calculating (approximating) the number of sheet media in input tray 12 according to the present invention. Media count manager 60 receives course granularity level values of media detected by sensor 130. Although in a preferred embodiment media count manager 60 is firmware in ROM 55, it is understood that it may also be embodied as software in RAM 50 or in circuitry (such as an ASIC).

Figure 2:
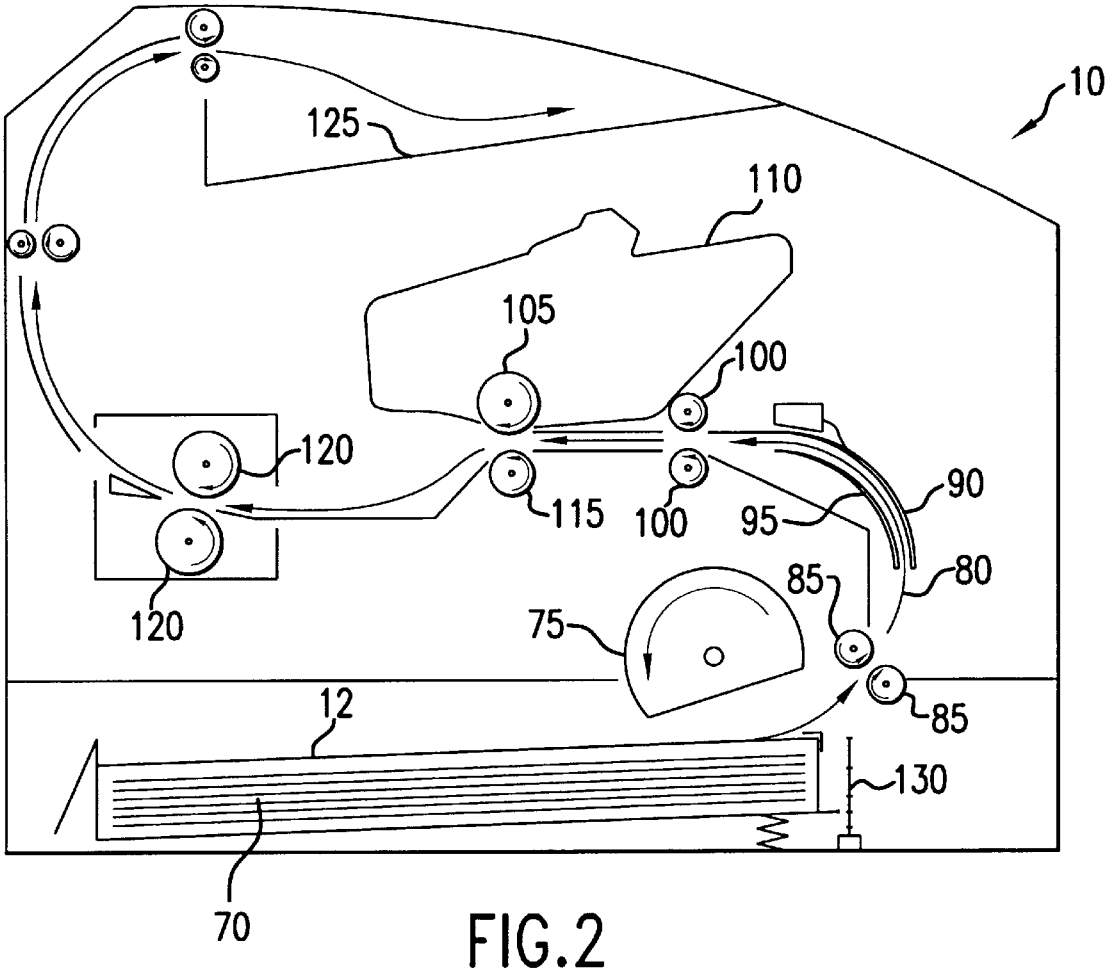
FIG. 2 is a schematic diagram of the printer and media holding tray of FIG. 1.

FIG. 2 is a schematic block diagram of printer 10 and media holding tray (input tray) 12 of FIG. 1. Input tray 12 holds sheet media 70. Feed roller 75 picks top sheet 80 from media stack 70 in input tray 12 and advances it to a pair of transport rollers 85. Transport rollers 85 further advance sheet 80 through paper guides 90 and 95 toward registration rollers 100. Registration rollers 100 advance paper 80 to photoconductive drum 105 (of toner cartridge 110) and transfer roller 115 where toner is applied as conventional in the art. Sheet 80 then moves through heated fuser rollers 120 and toward output bin 125.

Sensor 130 is coupled to tray 12 and detects coarse granularity levels of media in tray 12. For purposes of the present invention, sensor 130 is any conventional sensor in the art, such as a ratchet or light sensor, that is capable of detecting and reporting a plurality of course granularity levels of media in tray 12. For example, sensor 130 detects when tray 12 is empty, and when tray 12 is filled to 25%, 50%, 75% or 100% capacity with sheet media.

Thus, in this example, the course granularity levels are at 25% increments and the same are detected and reported by sensor 130. Alternatively, sensor 130 may detect and report course granularity levels of 10% increments, 20% increments, 33% increments, or the like. In any case, sensor 130 communicates such course granularity levels to media count manager 60 (FIG. 1). It should be noted that although sensor 130 detects a plurality of course granularity levels of media in tray 12, it does not detect an actual count of sheet media in tray 12.

Under the present invention, media count manager 60 calculates an actual or approximate media count using the course granularity levels reported by sensor 130 and further using a preferred method described herein. Importantly, the present invention enables an approximate sheet count regardless of the thickness of the sheet media used in tray 12 (so long as all of the media in the tray is of the same thickness). Thus, the present invention is adaptive to differing sheet media thickness. Additionally, media count manager 60 enables a calculation of sheet media count that is adaptive to differing graduations, fluctuations or inaccuracies in course media level measurements detected by sensor 130 as will be described further herein.

Figure 3:
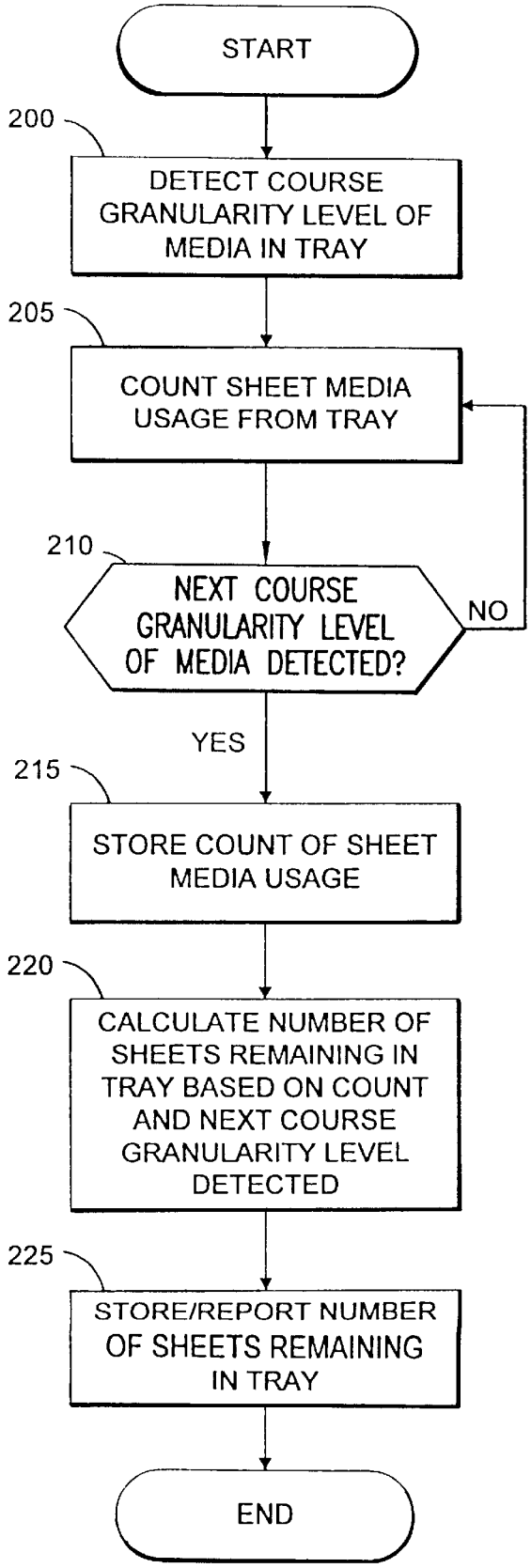
FIG. 3 is a flow chart depicting a preferred method of the present invention.

Referring now to FIG. 3, a flow chart depicts a preferred method of the present invention for determining a number (or count) of sheet media in an input tray 12 based on certain detected course granularity levels of media in the tray. First, 200, a course granularity level of media is detected in tray 12 by sensor 130 and reported to media count manager 60. In a preferred embodiment, the course granularity level is reported to media count manager 60 as a value that is easily manipulated, such as an integer. For example, if sensor 130 detects five course granularity levels of media in tray 12 at increments of 0%, 25%, 50%, 75% and 100%, then respective course granularity level values are reported to media count manager 60. Namely, if 0% is detected then a value of 0 is reported; if 25% is detected then a value of 1 is reported; if 50% is detected then a value of 2 is reported; if 75% is detected then a value of 3 is reported; and if 100% is detected then a value of 4 is reported. Although number values 0–4 are described/reported in this example, it is clear that other values are similarly feasible for use under the present invention.

Next, 205, a count is kept of the number of media (sheets) used from tray 12 during processing in printer 10. Specifically, each sheet that is picked from tray 12 to be processed by printer 10 is counted, and the total count is kept. Subsequently, when a next course granularity level 210 of media is detected in tray 12 by sensor 130, then the total sheet count used from tray 12 (since the last course granularity level of media detected) is stored 215 in memory 50. It should be noted that the mechanism for counting actual sheets processed within printer 10 may be firmware, software, circuitry and/or other mechanical, electrical or other means as conventional in the art. The number of sheets processed within printer 10 is tracked by and/or reported to media count manager 60.

Next, the number of sheets remaining in tray 12 is calculated by media count manager 60. This is accomplished 220 by multiplying the total count by the next course granularity level value detected. For example, if 50 sheets are counted (processed in printer 10) and the next course granularity level value detected is 3 (i.e., 75% full), then a close approximation of the number of sheets remaining in tray 12 is: 50×3=150 sheets.

Subsequently, this calculated number of sheets remaining in tray 12 is stored and/or reported by media count manager 60 to enable further tracking and reporting of the sheet count in tray 12 during continued use of printer 10. For example, using the numbers just referenced, media count manager 60 reports the course granularity level of 75% and/or the calculated approximate sheet count of 150 to the print driver interface in host 45 (FIG. 1).

Alternatively, these numbers are reported directly to display panel 65 on printer 10. In either case, importantly, this reporting notifies a user of the approximate amount of sheets available in tray 12 of printer 10 from which the user is able to determine whether sufficient sheets remain for any given print job to be processed.

Alternatively, the method of FIG. 3 is modified to account for and compensate for all course granularity levels detected as sheets are further consumed in printer 10. Specifically, for example, an average sheet count usage is stored 215 in RAM 50 rather than simply the most recently detected sheet count. The average sheet count usage is calculated and kept over multiple course granularity levels or over multiple media tray uses, thus enabling an extremely adaptive sheet count/approximation in tray 12 under the present invention. To clarify, each time a next course granularity level is detected 210, instead of simply storing the current count of sheet media usage 215, the current count is averaged with the existing count and then the average is stored (215). One example of a simple calculation to accomplish this is: new stored count=(current count+stored count)/2. However, other adaptive methods are also equally feasible under principles of the present invention.

In yet a further alternate embodiment, the method of FIG. 3 is modified to adapt to non-linear measurements reported by sensor 130. In other words, if sensor 130 is not linear in its percentage measurements of the levels of media, this is accounted for by storing the sheet count usage for each coarse granularity level and averaging each level's sheet count with a respective level's sheet count on a next batch (i.e., refill) of sheet media in tray 12. Thus, over a period of two or more batches of sheet media in tray 12, where coarse granularity levels are detected during each batch and a respective sheet count is stored for those levels in each batch, non-linear measurements reported by sensor 130 are adapted into/by media count manager 60 for improved sheet count reporting. For example, if sensor 130 detects 25% increment levels, and 40 sheets are used/counted for each level during the first three levels (100%–25% full), but 50 sheets are used/counted during the fourth level (25%–0% full), then these variations are accounted for over multiple tray uses by media count manager 60, by comparing/averaging respective level sheet count uses across the multiple tray refills, to more accurately report to a user how many sheets remain, depending on what coarse granularity level is detected.

In summary, the present invention provides an apparatus and method for enabling an approximation of sheet count in a media tray of an imaging device by utilizing course granularity levels of media detected in the tray in combination with actual sheet usage in the imaging device. It will be obvious to one of ordinary skill in the art that the present invention is easily implemented utilizing any of a variety of components and tools existing in the art. Moreover, while the present invention has been described by reference to specific embodiments, it will be apparent that other alternative embodiments and methods of implementation or modification may be employed without departing from the true spirit and scope of the invention.

What is claimed is:

1. A method of determining media count in a media holding tray, comprising:

(a) detecting a first level of media in the holding tray;

(b) counting a number of individual media removed from the holding tray;

(c) detecting a second level of media in the holding tray; and, (d) calculating the number of media remaining in the holding tray based upon at least the second level of media detected and the counted number of individual media removed from the tray.

2. The method of claim 1 wherein the first and second levels are indicative, respectively, of how full the media holding tray is.

3. The method of claim 1 wherein the first and second levels are known proportions relative to a full capacity of the media holding tray.

4. The method of claim 1 wherein the step of calculating includes working a value indicative of the second level with the counted number of individual media removed from the tray.

5. The method of claim 1 wherein the step of calculating includes working a value indicative of the second level with an average of the counted number of individual media removed from the tray over multiple levels detected.

6. The method of claim 1 wherein the step of calculating includes working a value indicative of the second level with an average of the counted number of individual media removed from the tray over multiple tray uses detected.

7. An imaging device, comprising:

(a) a print engine;

(b) a media holding tray coupled to the print engine;

(c) a media level detecting mechanism coupled to the media holding tray for detecting at least first and second levels of media in the holding tray;

(d) means for counting a number of individual media removed from the holding tray during processing by the imaging device; and, (e) means for calculating a number of media remaining in the holding tray based upon at least the second level of media detected and the counted number of individual media removed from the tray.

8. The imaging device of claim 7 wherein the first and second levels are indicative, respectively, of how full the media holding tray is.

9. The imaging device of claim 7 wherein the first and second levels are known proportions relative to a full capacity of the media holding tray.

10. The imaging device of claim 7 wherein the means for calculating includes firmware, software or circuitry for multiplying a value indicative of the second level by the counted number of individual media removed from the tray.

11. The imaging device of claim 7 wherein the means for calculating includes firmware, software or circuitry for working a value indicative of the second level with an average of the counted number of individual media removed from the tray over multiple levels detected.

12. The imaging device of claim 7 wherein the means for calculating includes firmware, software or circuitry for working a value indicative of the second level with an average of the counted number of individual media removed from the tray over multiple tray uses detected.

13. The imaging device of claim 7 wherein the print engine is an electrophotographic or inkjet print device.

* * * * *